US007222473B2

(12) United States Patent
Jones

(10) Patent No.: US 7,222,473 B2
(45) **Date of Patent: *May 29, 2007**

(54) ANGLED RIDING STIRRUP

(76) Inventor: David E. Jones, 34088 FM 2481, Hico, TX (US) 76457

( * ) Notice: Subject to any disclaimer, the term of this patent is extended or adjusted under 35 U.S.C. 154(b) by 0 days.

This patent is subject to a terminal disclaimer.

(21) Appl. No.: 10/720,880

(22) Filed: Nov. 24, 2003

(65) Prior Publication Data

US 2004/0103623 A1 Jun. 3, 2004

Related U.S. Application Data

(63) Continuation of application No. 09/728,533, filed on Dec. 1, 2000, now Pat. No. 6,651,409.

(60) Provisional application No. 60/168,885, filed on Dec. 3, 1999.

(51) Int. Cl.
*B68C 3/00* (2006.01)

(52) U.S. Cl. ..... 54/47

(58) Field of Classification Search ..... 54/47, 54/48, 49, 49.5

See application file for complete search history.

(56) References Cited

U.S. PATENT DOCUMENTS 33,690 A * 12/1861 Goodman ..... 54/47
33,930 A * 12/1861 Eagle ..... 54/47
38,995 A * 6/1863 Towers ..... 54/47
380,276 A * 3/1888 Butler ..... 54/49
5,172,538 A * 12/1992 Luger ..... 54/47
6,651,409 B2 * 11/2003 Jones ..... 54/47

OTHER PUBLICATIONS

Eastwest/Merryearn Catalog; 1996; pp. 10, B-25, B-26, B-29.
Declaration for Edgar Staley Gorrell dated Aug. 6, 2005, and Appendix in Civil Action No. 3:04-CV-2695-B in the United States District Court for the Northern District of Texas (8 pages).
Gorrell, Course Title: SADDLEMAKING II—Basic Saddlemaking, Colorado Mountain College Lesson Outline (1 Page).
Ward, "Profile: Pete Gorrell", Steamboat Pilot newspaper article, Apr. 9, 1992 (3 Pages).
Gorrell, "Sore Knee Syndrome", Shop Talk magazine article, Feb. 2005 (4 Pages).
Photographs of Gorrell Saddle with canted stirrups, (2 Pages).

(Continued)

*Primary Examiner*—Robert P. Swiatek
(74) *Attorney, Agent, or Firm*—Russell D. Culbertson; The Culbertson Group, P.C.

(57) ABSTRACT

A riding stirrup (10) includes a hanger rod (11) for connecting the stirrup to a saddle, and a stirrup loop (12) connected to the hanger rod. The stirrup loop (12) defines a stirrup opening (14) through which a rider may extend their foot when the rider is sitting in the saddle. The stirrup loop (12) also includes an elongated base support tread (17) positioned generally at the bottom of the loop. The base support tread (17) extends at a slant with respect to a stirrup centerline (CL) which extends perpendicular to the longitudinal axis of the hanger rod (11), through a midpoint of the rod, and through the base support tread. This slant places the distance between an outer tread section (21) and the hanger rod (11) greater than the distance between an inner tread section (20) and the hanger rod.

14 Claims, 2 Drawing Sheets

OTHER PUBLICATIONS

Gorrell Saddle Order Form by Pete Gorrell for Custom Saddlery for Mr. James O. Huber, Mar. 21, 1991 (2 Pages).
Gorrell Schematic Design for Mr. James O. Huber's saddle and photograph of Gorrell canted stirrup (2 Pages).
Photographs of Saddle with Canted Stirrup, (3 Pages).
Photograph of Angled or Offset Stirrup Tread, (1 Page).
1995 Stubben Catalog (55 Pages).
Memorandum and Authorities in Support of Defendant's Motion for Summary Judgment in Civil Action No. 3:04-CV-2695-B in the U.S. District Court for the Northern District of Texas, Dallas Division, with Exhibit F, Aug. 12, 2005 (38 Pages).

* cited by examiner

ANGLED RIDING STIRRUP

CROSS-REFERENCE TO RELATED APPLICATION

This application is a continuation of U.S. patent application Ser. No. 09/728,533, filed Dec. 1, 2000 now U.S. Pat. No. 6,651,409, and entitled "Angled Riding Stirrup," which claims the benefit of U.S. Provisional Patent Application No. 60/168,885 entitled "Intentionally Crooked Stirrup," filed Dec. 3, 1999. The entire content of these applications are incorporated in the present application. The Applicant claims priority from U.S. patent application Ser. No. 09/728,533 under 35 U.S.C. 120 and claims priority from provisional application 60/168,885 under 35 U.S.C. 119.

FIELD OF THE INVENTION

The invention relates to riding gear and, more particularly, to a stirrup for use with a riding saddle, especially a western equestrian riding saddle.

BACKGROUND OF THE INVENTION

The traditional western riding stirrup helps dictate the position of the rider's body and legs while also providing a base of support for the rider. Stirrups are generally used in pairs, with one stirrup hanging on stirrup leathers on each side of the saddle. The stirrups hang from the saddle in position to accept the rider's feed when the rider is sitting in the saddle. Each stirrup includes generally a hanger for connecting to the stirrup leathers, two lateral sides, and a base or tread portion on which the rider's foot actually rests.

Traditionally, a new rider assumes a sitting position in a western saddle and adjusts the stirrup leather length in an attempt to place the bottom or base of each stirrup where it provides the most stability to the rider. Over an extended period of practice, the rider then learns to adjust their foot, leg, and body position to facilitate an acceptable horsemanship quality to the riding position.

There have been many variations in western stirrups. Common variations include variations in the length and width of the tread or base portion of the stirrup. In all of the numerous prior art variations in riding stirrups, however, the rider's weight was unevenly distributed on their feet. Specifically, straddling the horse placed greater pressure on the outer most side of the rider's feet and toes. This uneven pressure on the stirrups often resulted in numbness in the feet, knee, ankle, foot, and leg pain, blisters and general riding discomfort.

Traditional saddles were, and still are, built with a rearward seat pocket and the stirrup leathers hung generally forward on the saddle to allow riders to more easily spread their knees and adjust their leg and foot position to lessen the pressure on the outer edge of each foot. However, this solution to the problem of uneven pressure on prior art stirrups severely degraded the rider's balance. The more pressure that is added to the stirrups to control balance, the more torque is generated, on the feet, to force the riders' knees in toward the horse. The riders' balance is adversely affected since the rider's center of gravity is raised significantly.

The vertical balance saddle which is the subject of U.S. Pat. No. 5,953,889 severely, and by design, restricted the ability of the rider to adjust in the saddle. The saddle forces a pre-defined, good, and effective horsemanship position in the saddle. However, the riding position causes the base (sole) of the rider's feet to tip (horizontally) with the outer edge of each foot considerably lower (closer to the ground) than the inside edge of the foot. These same conditions were also evident to a lesser extent in prior western equestrian saddles.

SUMMARY OF THE INVENTION

It is an object of the invention to provide a riding stirrup which overcomes the above-described problems associated with stirrups used with riding saddles, particularly western riding saddles.

A riding stirrup according to the invention includes a hanger rod for connecting the stirrup to a saddle, and a stirrup loop connected to the hanger rod. The stirrup loop defines a stirrup opening through which a rider may extend their foot when the rider is sitting in the saddle. The stirrup loop includes an elongated base support tread positioned generally at the bottom of the loop. According to the invention, the base support tread extends at a slant with respect to a stirrup centerline which extends perpendicular to the longitudinal axis of the hanger rod, through a midpoint of the rod, and through the base support tread. That is, unlike prior art stirrups, the base support tread according to the present invention does not extend perpendicular to the stirrup centerline.

The base support tread may be thought of as having an inner tread section and an outer tread section. The inner tread section is positioned nearest the horse when the stirrup is in the operating position and is adapted to support the inside of the rider's foot. The outer tread section is farther away from the horse when the stirrup is in the operating position and provides a surface for supporting the outside of the rider's foot. The slant of the base support tread is such that the distance between the inner tread section and hanger rod is less than the distance between the hanger rod and outer tread section. That is, considering a horizontal plane positioned above the level of the base support tread, the base support tread slants away from the plane in the direction from the inner tread section toward the outer tread section.

The inner tread section defines an inner angle with the stirrup centerline which is less than an outer angle defined between the outer tread section and the stirrup centerline. In the preferred form of the invention in which the inner tread section is coplanar with the outer tread section, the inner angle comprises an acute angle whereas the outer angle comprises an obtuse angle.

The angled stirrup base tread according to the invention provides a substantial increase in the rider's balance. The rider's feet more generally fit flat against the base portion of the stirrup giving the rider a very noticeable sense of increased security in the saddle. Also, the rider's center of gravity is lowered since the knees are no longer torqued severely inwardly toward the horse. The riding stirrups according to the invention also help eliminate numbness and pain in the outer edges of the rider's feet and toes, as well as discomfort in the rider's ankles and legs.

When the stirrup according to the present invention is used with a traditional western saddle or the improved saddle described in U.S. Pat. No. 5,953,889 many of the riding instruction techniques used over the years in western riding become unnecessary. That is, the present stirrups dictate many of the correct horsemanship riding position characteristics and eliminate the necessity for the rider to constantly adjust in the saddle to retain a proper riding position.

These and other objects, advantages, and features of the invention will be apparent from the following description of the preferred embodiments, considered along with the accompanying drawings.

DESCRIPTION OF THE PREFERRED EMBODIMENT

Figure 1:
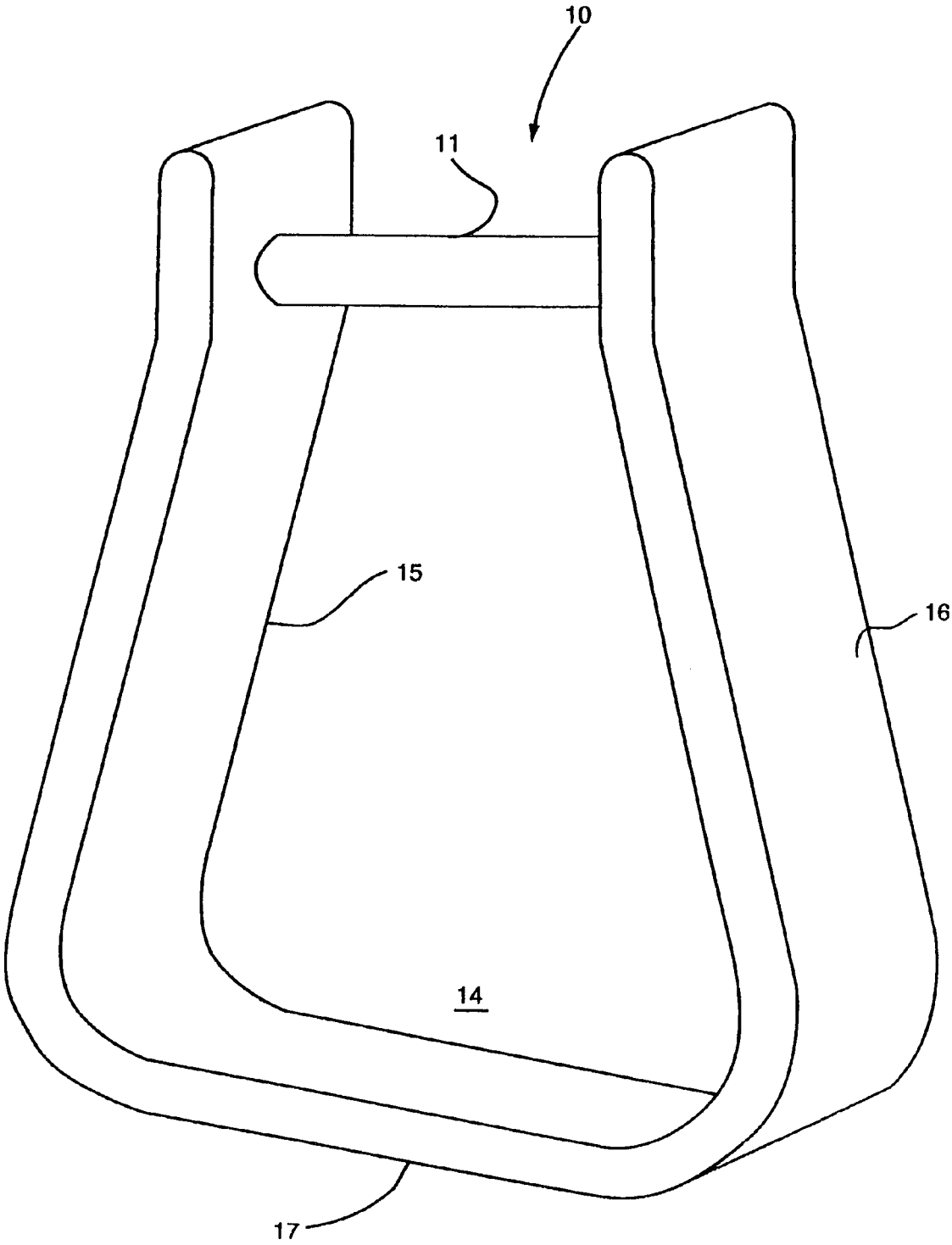
FIG. 1 is a view in perspective of a riding stirrup embodying the principles of the present invention.

A stirrup 10 for use on a western equestrian saddle (not shown) is suspended from the saddle on stirrup leathers (not shown) which receive a stirrup hanger rod 11. Hanger rod 11 is preferably at least 2 inches in length and is connected to a stirrup loop shown generally at reference numeral 12. Stirrup loop 12 defines a loop or stirrup opening 14 through which the rider extends the front portion of their foot when in the riding position. The illustrated stirrup loop 12 includes an interior side 15, an exterior side 16, and an elongated base support tread 17. The sides 15 and 16 of the stirrup loop taper outwardly or diverge in the direction from hanger rod 11 toward the base support tread 17.

Stirrups such as the illustrated stirrup 10 are generally used in pairs with one stirrup suspended from each lateral side of the saddle. The interior side 15 of the stirrup is side of the stirrup that is closest to the horse when in the operating position for the stirrup. The length of interior side 15 is generally shorter than the length of the exterior side 16 due to the angle or slant of base support tread 17. Both interior and exterior side (15 and 16) of the stirrup will be, but not limited to, generally equidistant from a stirrup centerline CL extending substantially perpendicular to the longitudinal axis of hanger rod 11, through a mid point of the stirrup hanger rod, and through the base support tread.

Figure 2:
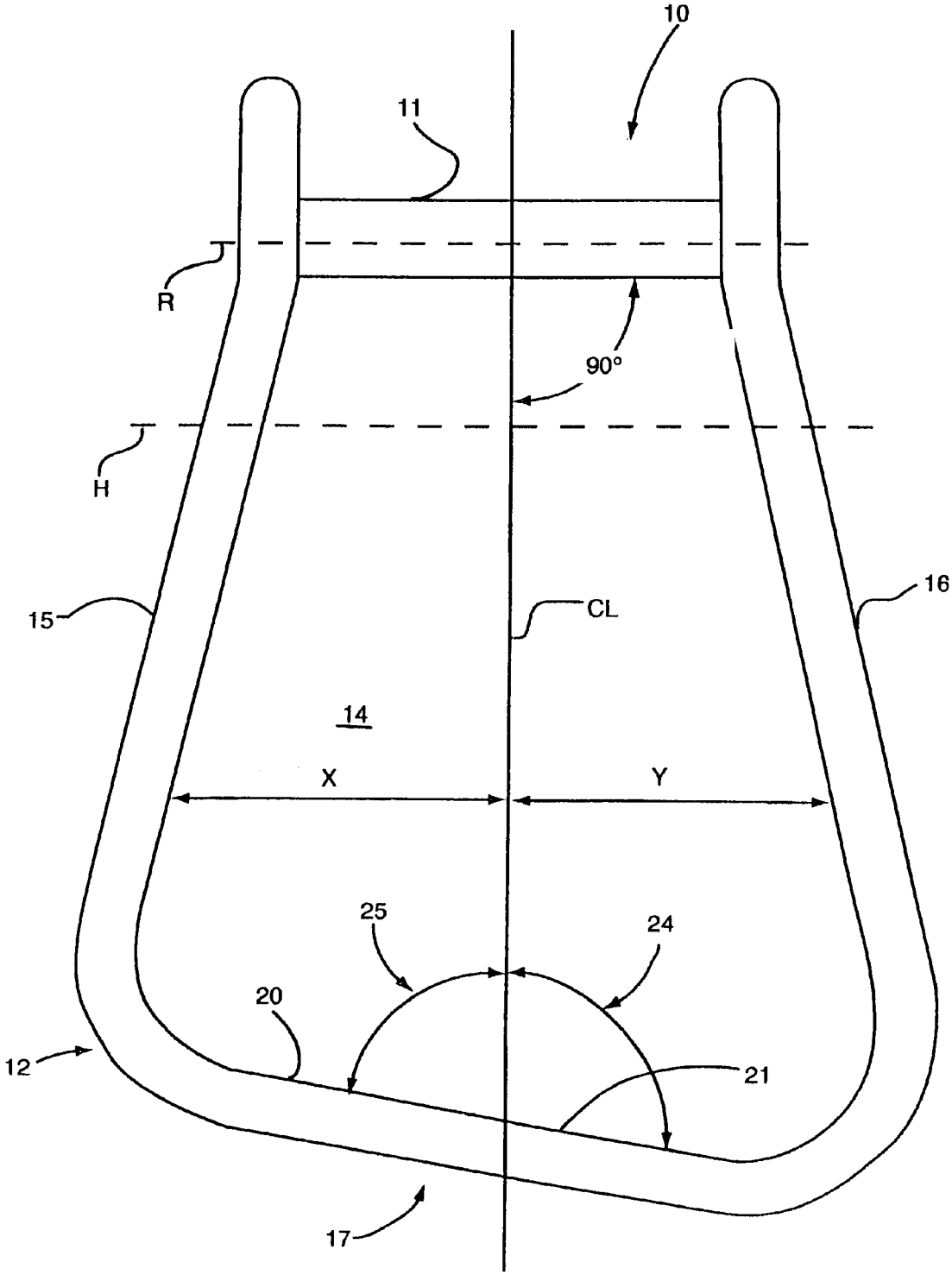
FIG. 2 is a rear view of the stirrup shown in FIG. 1.

As best shown in FIG. 2, base support tread 17 is located, nominally centered, on stirrup centerline CL. Also, base support tread 17 is angled or slanted downwardly from an inner tread section 20 toward an outer tread section 21, away from the horse body when the stirrup is in the operating position. That is, with respect to a horizontal plane H above the level of base support tread 17 when the stirrup 10 is in the operating position, the elongated base support tread slants so that the shortest distance between the upper surface of inner tread section 20 and the horizontal plane is less than the shortest distance between the upper surface of the outer tread section 21 and the horizontal plane. In the preferred form of the invention illustrated in the figures the longitudinal axis R of hanger rod 11 extends generally horizontally when stirrup 10 is in the operating position.

With the angle of the base support tread 17 the upper surface of outer tread section 21 defines an outer angle 24 with respect to stirrup centerline CL which is greater than an inner angle 25 defined by the upper surface of inner tread section 20 and the stirrup centerline. Also, the upper surface of the preferred inner tread section 20 is coplanar with the upper surface of the outer tread section 21 so that the surfaces extend along a straight line with inner angle 24 comprising an acute angle and outer angle 25 comprising an obtuse angle.

The stirrup 10 may be machined from blocks of solid aluminum or cast in aluminum or other suitable metal. Stirrup 10 may also be made from a variety of materials including, but not limited to, wood, plastic, fiberglass or combinations thereof. Protective and/or decorative coverings (not shown) for the stirrups may include rawhide, leather, cloth, paint, silver, gold, bronze, powder coat, combinations of coverings and coatings or simply no covering at all.

As used herein, whether in the above description or the following claims, the terms "comprising," "including," "having," and the like are to be understood to be open-ended, that is, to mean including but not limited to. Only the transitional phrases "consisting of" and "consisting essentially of," respectively, shall be closed or semi-closed transitional phrases.

The above described preferred embodiments are intended to illustrate the principles of the invention, but not to limit the scope of the invention. Various other embodiments and modifications to these preferred embodiments may be made by those skilled in the art without departing from the scope of the following claims.

The invention claimed is:

1. A riding stirrup suspended from a western equestrian saddle, the riding stirrup comprising:

(a) a hanger rod;

(b) a stirrup loop connected to the hanger rod at both ends of the hanger rod and defining a stirrup opening;

(c) an elongated base support tread at a bottom portion of the stirrup loop and spaced apart from the hanger rod, the elongated base support tread having an upper surface with a longitudinal center axis extending at a slant with respect to a stirrup centerline, the stirrup centerline extending substantially perpendicular to the hanger rod, substantially through a mid point of the hanger rod, and the upper surface of the elongated base support tread being approximately centered on the stirrup centerline; and (d) wherein the upper surface of the elongated base support tread is slanted with respect to the hanger rod such that the shortest distance between an inner tread end of the elongated base support tread and the longitudinal axis of the hanger rod is less than the shortest distance between an outer tread end of the elongated base support tread and the longitudinal axis of the hanger rod, and such that the upper surface of the elongated base support member slopes downwardly away from a position of a horse under the saddle.

2. The riding stirrup according to claim 1 wherein:

(a) the upper surface of the elongated base support tread defines an inner angle with the stirrup centerline at an inward side of the stirrup centerline;

(b) the upper surface of the elongated base support tread defines an outer angle with the stirrup centerline at an outward side of the stirrup centerline; and (c) the inner angle is less than the outer angle.

3. The riding stirrup according to claim 2 wherein the outer angle comprises an obtuse angle and the inner angle comprises an acute angle.

4. The riding stirrup according to claim 3 wherein the upper surface of the elongated base support tread is substantially planar.

5. The riding stirrup according to claim 1 further including:

(a) an interior side member connected to the hanger rod; and (b) an exterior side member connected to the hanger rod, the exterior side member being longer than the interior side member; and (c) wherein a lower portion of the interior side member diverges from a lower portion of the exterior side member along the stirrup centerline in the direction from the hanger rod to the elongated base support tread.

6. The riding stirrup according to claim 1 wherein the upper surface of the elongated base support tread extends substantially parallel to a lower surface of the elongated base support tread.

7. A western equestrian saddle including:

(a) a first stirrup including, (i) a first hanger rod received in first stirrup leathers depending from the saddle, a first stirrup centerline extending substantially perpendicular to the first hanger rod through a mid point of the first hanger rod, (ii) a first stirrup loop connected to the first hanger rod at both ends of the first hanger rod and defining a first stirrup opening, (iii) a first elongated base support tread at a bottom portion of the first stirrup loop and spaced apart from the first hanger rod, the first elongated base support tread having an upper surface that is approximately centered on the first stirrup centerline, and is slanted with respect to the first stirrup centerline such that the shortest distance between an inner tread end of the first elongated base support tread and the longitudinal axis of the first hanger rod is less than the shortest distance between an outertread end of the first elongated base support tread and the longitudinal axis of the first hanger rod;

(b) a second stirrup including, (i) a second hanger rod received in second stirrup leathers depending from the saddle, a second stirrup centerline extending substantially perpendicular to the second hanger rod through a mid point of the second hanger rod, (ii) a second stirrup loop connected to the second hanger rod at both ends of the second hanger rod and defining a second stirrup opening, (iii) a second elongated base support tread at a bottom portion of the second stirrup loop and spaced apart from the second hanger rod, the second elongated base support tread having an upper surface that is approximately centered on the second stirrup centerline, and is slanted with respect to the second stirrup centerline such that the shortest distance between an inner tread end of the second elongated base support tread and the longitudinal axis of the second hanger rod is less than the shortest distance between an outer tread end of the first elongated base support tread and the longitudinal axis of the second hanger rod; and (c) wherein the upper surface of the first elongated base support tread and the upper surface of the second elongated base support both face outwardly away from each other when the first and second stirrups are each in a respective operating position.

8. The saddle of claim 7 wherein:

(a) the upper surface of the first elongated base support tread extends substantially parallel to a lower surface of the first elongated base support tread; and (b) the upper surface of the second elongated base support tread extends substantially parallel to a lower surface of the first elongated base support tread.

9. The saddle of claim 7 wherein:

(a) the first stirrup loop includes an interior side member extending between the first hanger rod and the first elongated base support tread and an exterior side member extending between the first hanger rode and the first elongated base support tread, the interior side member of the first stirrup loop being shorter than the exterior side member of the first stirrup loop; and (b) the second stirrup loop includes an interior side member extending between the second hanger rod and the second elongated base support tread and an exterior side member extending between the second hanger rode and the second elongated base support tread, the interior side member of the second stirrup loop being shorter than the exterior side member of the second stirrup loop.

10. A method for providing a support surface for a rider's foot in connection with the use of a western equestrian saddle, the method including:

(a) suspending a hanger rod from the saddle at a first lateral side of the saddles, a stirrup centerline extending substantially perpendicular to the hanger rod through a mid point of the hanger rod;

(b) supporting a stirrup loop from the hanger rod, the stirrup loop having a support surface defined therein, the support surface being slanted with respect to the stirrup centerline so that the support surface faces away from the saddle when the stirrup loop is in an operating position, and wherein the support surface is approximately centered on the stirrup centerline.

11. The method of claim 10 wherein supporting the stirrup loop includes supporting an elongated base support tread which forms a bottom portion of the stirrup loop and wherein the support surface comprises an upper surface of the elongated base support tread.

12. The method of claim 11 wherein supporting the stirrup loop includes supporting an interior side of the stirrup loop and an exterior side of the stirrup loop, the interior side of the stirrup loop and exterior side of the stirrup loop each extending from the hanger rod to a respective end of the elongated base support tread, and wherein the interior side of the stirrup loop is shorter than the exterior side of the stirrup loop and faces toward the saddle when the stirrup loop is in the operating position.

13. A stirrup suspended from a western equestrian saddle, the stirrup comprising:

(a) a hanger rod suspended from the saddle at a first lateral side of the saddle;

(b) a stirrup loop connected to the hanger rod, the stirrup loop including a base support tread spaced apart from the hanger rod, an interior side extending from the hanger rod to a first end of the base support tread, and an exterior side extending from the hanger rod to a second end of the base support tread, the interior side being shorter than the exterior side so that an upper surface the base support tread is slanted with respect to the hanger rod, and the interior side being positioned so that the upper surface of the base support tread faces away from the saddle.

14. The stirrup of claim 13 wherein the base support tread includes a lower surface that extends substantially parallel to the upper surface of the base support tread.

* * * * *

UNITED STATES PATENT AND TRADEMARK OFFICE

CERTIFICATE OF CORRECTION

PATENT NO. : 7,222,473 B2
APPLICATION NO. : 10/720880
DATED : May 29, 2007
INVENTOR(S) : David E. Jones It is certified that error appears in the above-identified patent and that said Letters Patent is hereby corrected as shown below:

At column 5, line 29, claim 7:
Change "outertread" to --outer tread--.

Signed and Sealed this

Thirty-first Day of July, 2007

JON W. DUDAS
*Director of the United States Patent and Trademark Office*